US010443275B2

(12) United States Patent
Nagata et al.

(10) Patent No.: US 10,443,275 B2
(45) Date of Patent: Oct. 15, 2019

(54) VEHICLE HANDLE DEVICE

(71) Applicant: AISIN SEIKI KABUSHIKI KAISHA, Kariya-shi, Aichi-ken (JP)

(72) Inventors: Koichi Nagata, Chiryu (JP); Nobukazu Araki, Hekinan (JP); Masaki Yoshino, Aichi-ken (JP); Jun Hasegawa, Nagoya (JP); Kazuki Takenaka, Kariya (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 393 days.

(21) Appl. No.: 15/363,190

(22) Filed: Nov. 29, 2016

(65) Prior Publication Data

US 2017/0152685 A1 Jun. 1, 2017

(30) Foreign Application Priority Data

Nov. 30, 2015 (JP) ..... 2015-233532

(51) Int. Cl.
*E05B 79/06* (2014.01)
*E05B 85/14* (2014.01)
*E05B 17/00* (2006.01)

(52) U.S. Cl.
CPC ..... *E05B 79/06* (2013.01); *E05B 85/14* (2013.01); *E05B 17/0012* (2013.01)

(58) Field of Classification Search
CPC ..... E05B 79/00; E05B 79/06; E05B 85/14; E05B 85/16; E05B 17/0012; Y10T 292/57; Y10S 292/53; Y10S 292/54
USPC ..... 16/412; 296/1.02, 146.1
See application file for complete search history.

(56) References Cited

U.S. PATENT DOCUMENTS 9,033,379 B2 5/2015 Tateishi et al.
9,322,200 B1 * 4/2016 Shimizu ..... E05B 85/16
2008/0185850 A1 * 8/2008 Takaya ..... E05B 79/06 292/336.3

(Continued)

FOREIGN PATENT DOCUMENTS

DE 202015103143 U1 * 8/2015 ..... E05B 85/16
JP 3397286 B2 4/2003

(Continued)

OTHER PUBLICATIONS

The extended European Search Report dated Apr. 18, 2017, by the European Patent Office in corresponding European Patent Application No. 16201460.9-1609. (7 pgs).

*Primary Examiner* — Alyson M Merlino
(74) *Attorney, Agent, or Firm* — Buchanan Ingersoll & Rooney PC

(57) ABSTRACT

A vehicle handle device: a resin handle support member having one surface in a vehicle width direction which faces one surface of a metal panel of a vehicle door; a handle rotatably supported by the handle support member and causing a locking device to perform a transition from a latched state to an unlatched state; a metal bolt penetrating through a through-hole and a bolt inserting hole, and having a head portion facing the other surface of the handle support member; a metal nut facing the other surface of the panel and screwed with the bolt; and a metal spacer positioned between the head portion and the other surface of the panel, and whose both end portions come into contact with the head portion and the one surface of the panel.

6 Claims, 13 Drawing Sheets

(56) References Cited

U.S. PATENT DOCUMENTS

| | | | | |
|---|---|---|---|---|
| 2011/0179602 | A1* | 7/2011 | Fujiwara | E05B 79/06 16/412 |
| 2014/0123716 | A1* | 5/2014 | Hidaka | E05B 85/16 70/91 |
| 2016/0160539 | A1* | 6/2016 | Saitou | E05B 85/16 292/336.3 |
| 2017/0030107 | A1* | 2/2017 | Naka | E05B 85/16 |

FOREIGN PATENT DOCUMENTS

| | | | | |
|---|---|---|---|---|
| JP | 2012-026205 | A | 2/2012 | |
| WO | 2015011973 | A1 | 1/2015 | |
| WO | WO-2016052286 | A1 * | 4/2016 | E05B 85/16 |

* cited by examiner

FRONT ⟷ REAR

VEHICLE HANDLE DEVICE

CROSS REFERENCE TO RELATED APPLICATIONS

This application is based on and claims priority under 35 U.S.C. § 119 to Japanese Patent Application 2015-233532, filed on Nov. 30, 2015, the entire contents of which are incorporated herein by reference.

TECHNICAL FIELD

This disclosure relates to a vehicle handle device.

BACKGROUND DISCUSSION

FIGS. 18 and 19 illustrate an example of an outside handle device that is fixed to an outer panel.

The outside handle device includes a handle support member, as a base member, and an outside handle that is positioned on a vehicle exterior side of the handle support member and is rotatably supported by the handle support member.

The base member has a through-hole that is formed to penetrate through the base member in a vehicle width direction (vehicle interior-exterior direction). A bolt, a nut, and a nut-position regulating member are attached in the through-hole in an integrated state.

As illustrated in FIG. 19, a threaded portion of the metal bolt is inserted into the through-hole from a vehicle interior side of the handle support member and a shaft portion of the metal nut is inserted into the through hole from the vehicle exterior side of the handle support member such that the threaded portion and the shaft portion are screwed in the through-hole.

Further, a cylindrical resin nut-position regulating member having an axis coaxial to axes of the threaded portion of the bolt and the shaft portion of the nut is slidably inserted into the through-hole and is in press contact with an inner circumferential surface of the through-hole. Therefore, when there is no force in an axial direction that acts on the nut-position regulating member, the nut-position regulating member is positioned in the through-hole. However, when there is a force in an axial direction that acts on the nut-position regulating member, the nut-position regulating member slides through the through-hole. Further, a flange is provided to a vehicle-exterior-side end portion of the nut-position regulating member so as to be positioned between a vehicle-exterior-side surface of the handle support member and a head portion of the nut. Therefore, movement of the nut to the handle support member side is regulated at a position at which the head portion of the nut comes into contact with the flange.

Before the outside handle device is attached to the outer panel, the bolt, the nut, and the nut-position regulating member are mounted in the through-hole in an integrated state. Here, before the outside handle device is attached to the outer panel, the nut-position regulating member is positioned on the vehicle exterior side from a position illustrated in FIG. 19 with respect to the through-hole and is disposed at the position. Therefore, a gap having a certain size is formed between the flange of the nut-position regulating member and the vehicle-exterior-side surface of the handle support member.

As illustrated in the figures, a handle attaching hole is formed in the metal outer panel which configures a vehicle-exterior-side surface of a vehicle door. Further, a bolt inserting hole, which is continuous to the handle attaching hole, is formed in an inner circumferential edge of the handle attaching hole.

When the outside handle device is attached to the outer panel, the handle support member is first caused to face a vehicle-interior-side surface of the outer panel and the flange of the nut-position regulating member is positioned through the handle attaching hole on the vehicle exterior side of the outer panel. Subsequently, the entire outside handle device is caused to slide to a rear side, and thereby portions of the nut-position regulating member and the shaft portion of the nut that project from the through-hole to the vehicle exterior side are positioned in the bolt inserting hole. In this state, the bolt is caused to rotate relatively with respect to the nut in a fastening direction, and thereby, as illustrated in FIG. 19, the handle support member, the outer panel, and the flange of the nut-position regulating member are sandwiched between the head portion of the bolt and the head portion of the nut, in a state in which the vehicle-interior-side surface of the outer panel and the handle support member come into contact with each other.

Then, the handle support member is fixed to the outer panel due to an axial force (fastening force) between the bolt and the nut.

Therefore, it is possible to perform a rotational operation of the outside handle with respect to the handle support member in a stable state.

Note that, as known in the related art, the outside handle is linked through a plurality of linkage members to a locking device provided in the vehicle door. Therefore, if the locking device is operated through the rotational operation of the outside handle, locked and unlocked states of the vehicle door with respect to a vehicle body are switched by the locking device.

JP 2012-26205A is an example of the related art.

In the outside handle device, the handle support member and (the flange of) the nut-position regulating member, which are both made of a resin, are sandwiched between the head portion of the bolt and the head portion of the nut, which are both made of metal.

However, the resin handle support member and nut-position regulating member do not have high creep resistance. Therefore, when the outside handle device is fixed to the outer panel, there is a concern that creep will occur in the handle support member and the nut-position regulating member due to a temperature increase in the outside handle device and the elapse of time and then, contact portions of the handle support member and the nut-position regulating member with the bolt and the nut will be subjected to the plastic deformation.

If the handle support member and the nut-position regulating member are subjected to the plastic deformation, the axial force (fastening force) of the bolt and the nut that acts on the handle support member and the nut-position regulating member is likely to decrease.

Then, when the outside handle is caused to rotate with respect to the handle support member, there is a concern that backlash will occur between the handle support member and the outer panel.

SUMMARY

Thus, a need exists for a vehicle handle device which is not suspectable to the drawback mentioned above An aspect of this disclosure is directed to a vehicle handle device including: a resin handle support member having one surface in a vehicle width direction which faces one surface of a metal panel of a vehicle door; a handle that is rotatably supported by the handle support member and causes, through rotating thereof, a locking device provided in the vehicle door to perform a transition from a latched state to an unlatched state; a metal bolt that penetrates through a through-hole penetrating through the handle support member in the vehicle width direction, that penetrates through a bolt inserting hole formed in the panel so as to be relatively movable in the vehicle width direction, and that has a head portion facing the other surface of the handle support member in the vehicle width direction; a metal nut that faces the other surface of the panel and is screwed with the bolt; and a metal spacer which is positioned between the head portion and the other surface of the panel, and whose both end portions in the vehicle width direction come into contact with the head portion and the one surface of the panel, respectively, when the head portion comes into contact with the other surface of the handle support member and the nut comes into contact with the other surface of the panel.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, embodiments disclosed here will be described with reference to the accompanying figures.

Figure 1:
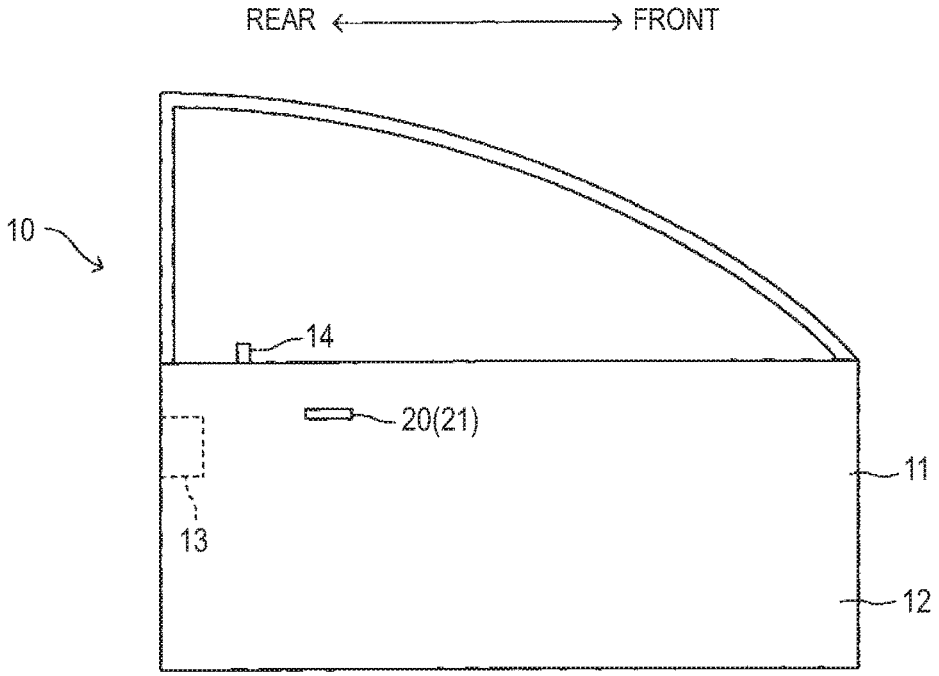
FIG. 1 is a side view of an outside handle device and a vehicle door of an embodiment disclosed here, when viewed from a vehicle exterior side.

A vehicle door 10 illustrated in FIG. 1 is supported to be rotatable around a rotary shaft in a vertical direction with respect to a vehicle body (not illustrated) and is capable of opening and closing an opening formed on a side of the vehicle body. The vehicle door 10 of the embodiment is a side door on the right side.

A lower half part of the vehicle door 10 is configured of a vehicle-exterior-side surface of a door main body 11, and the vehicle-exterior-side surface is configured of an outer panel 12 which is formed of a metal plate.

A locking device 13 is provided inside the vehicle door 10, and a part of the locking device is exposed through a rear end surface of the vehicle door 10. The locking device 13 has a known structure that includes a latch or a pole. The locking device 13 is linked to a locking knob 14 that is slidably provided on an upper end surface of a trim (not illustrated) which configures a vehicle-interior-side surface of the vehicle door 10. Further, the locking device 13 is linked to the outside handle device 20 that includes an outside handle 21 that is rotatably supported by the outer panel 12.

As known in the related art, when the locking knob 14 is positioned at a locking position (not illustrated) in a case where the vehicle door 10 closes the opening of the vehicle body, the locking device 13 is in a latched state in which a latch grips a striker (not illustrated) fixed to the vehicle body. In this case, even when the outside handle 21 is subjected to a rotating operation from an initial position (position illustrated in FIGS. 1 and 16), the locking device 13 is maintained in the latched state. In comparison, in a case where the locking knob 14 is positioned at an unlocking position (position in FIG. 1), the locking device 13 enters an unlatched state in which the latch releases the striker when the outside handle 21 is caused to rotate from the initial position to the vehicle exterior side and is caused to move to an operation position (not illustrated). Hence, it is possible to cause the vehicle door 10 to rotate in an opening direction with respect to the vehicle body.

Subsequently, a detailed structure of the outside handle device 20 (handle device) will be described.

The outside handle device 20 includes, as a large configurational member, the outside handle 21 (handle), a handle support member 23, a spacer 37, a bolt 42, a nut-position regulating member 46, a nut 49, a handle support arm 54, and a cover member 57.

Figure 7:
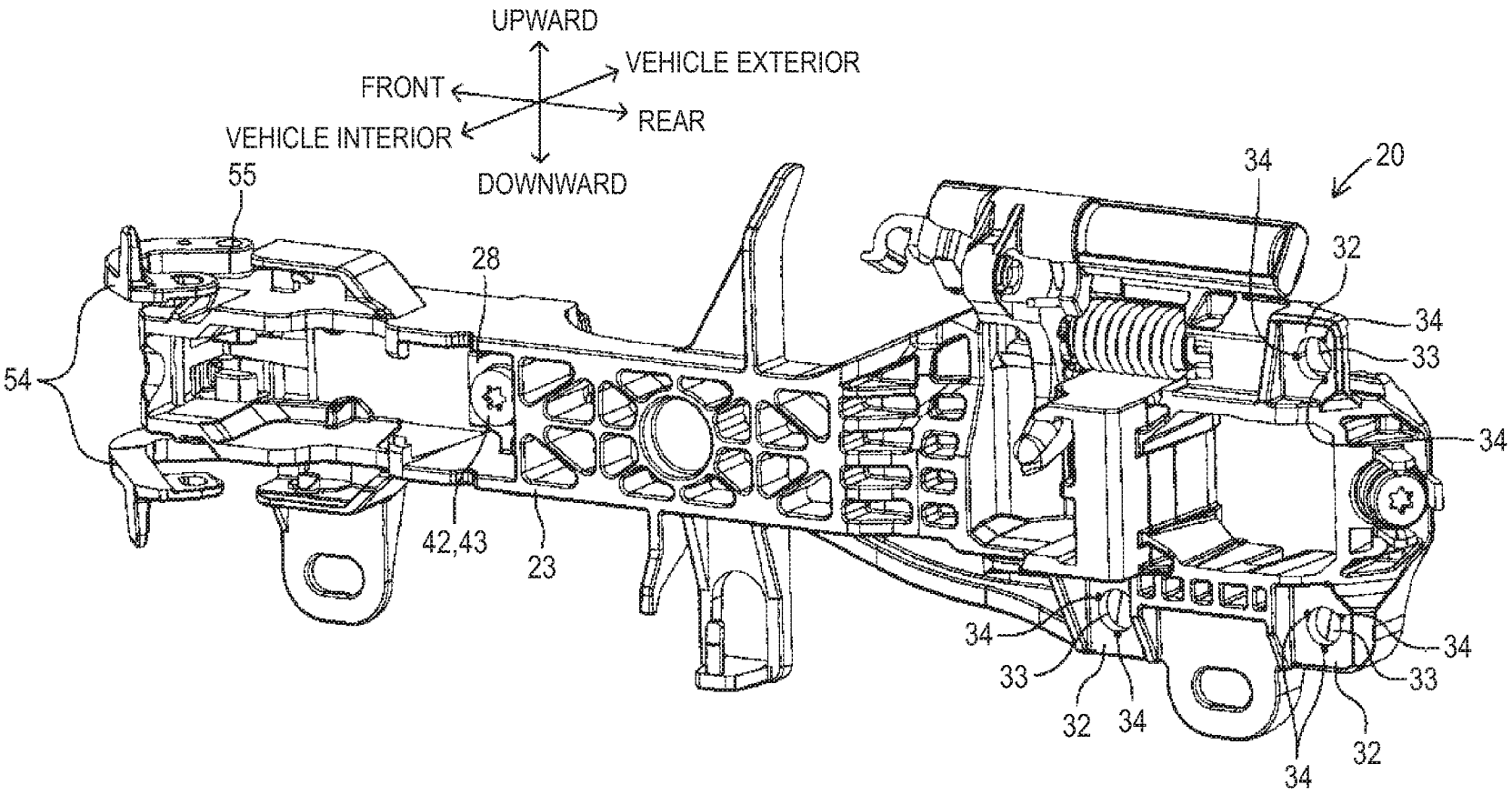
FIG. 7 is a perspective view of the outside handle device in which the outside handle and a cover member are omitted, when viewed from a vehicle interior side.
Figure 8:
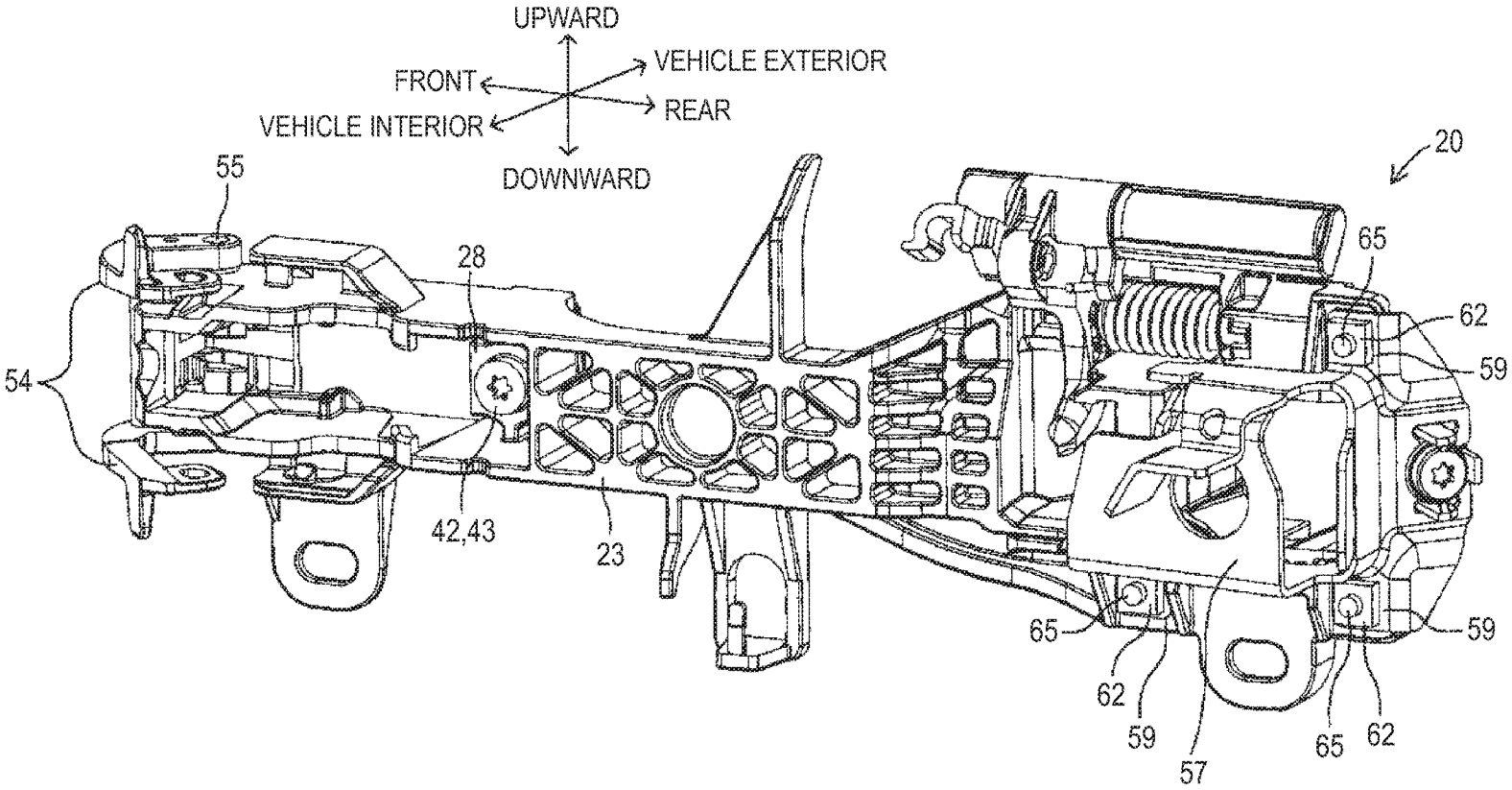
FIG. 8 is a perspective view similar to FIG. 7, when the cover member is mounted to the handle support member.

The hard resin handle support member 23 is an integral molding product extending in a frontward-rearward direction as illustrated in FIGS. 7 and 8.

As illustrated in FIGS. 2, 6, 10 and 16, a through-hole 24, which penetrates through the handle support member 23 in a vehicle width direction (vehicle interior-exterior direction), is formed in a portion that is positioned slightly in front from the central portion of the handle support member 23 in a longitudinal direction thereof. As illustrated in FIG.

Figure 2:
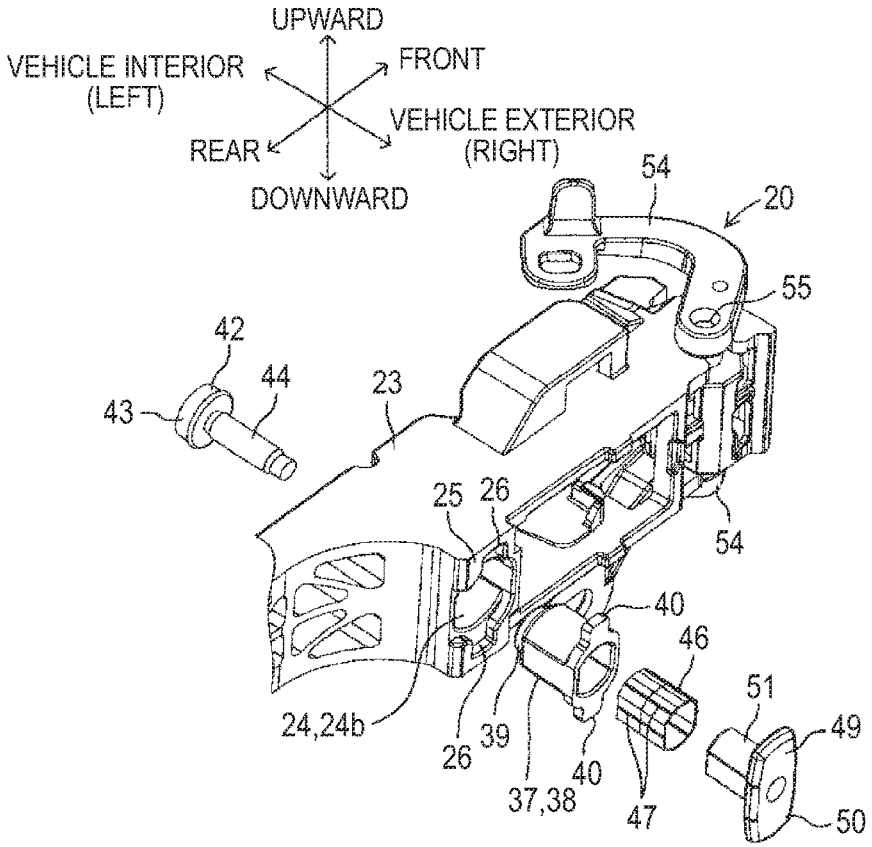
FIG. 2 is a perspective view of the outside handle device in which an outside handle is omitted, when viewed from the vehicle exterior side.

10, a vehicle-interior-side end portion 24*a* of the through-hole 24 formed in a vehicle-interior-side surface of the handle support member 23 has a circular cross section. In comparison, as illustrated in FIG. 2, a main body 24*b* without a vehicle-interior-side end portion 24*a* of the through-hole 24 has a non-circular cross section. Specifically, the main body has a shape formed by cutting off, with straight lines extending in a vertical direction, a front portion and a rear portion of a circle having a diameter larger than that of the vehicle-interior-side end portion 24*a*.

Figure 3:
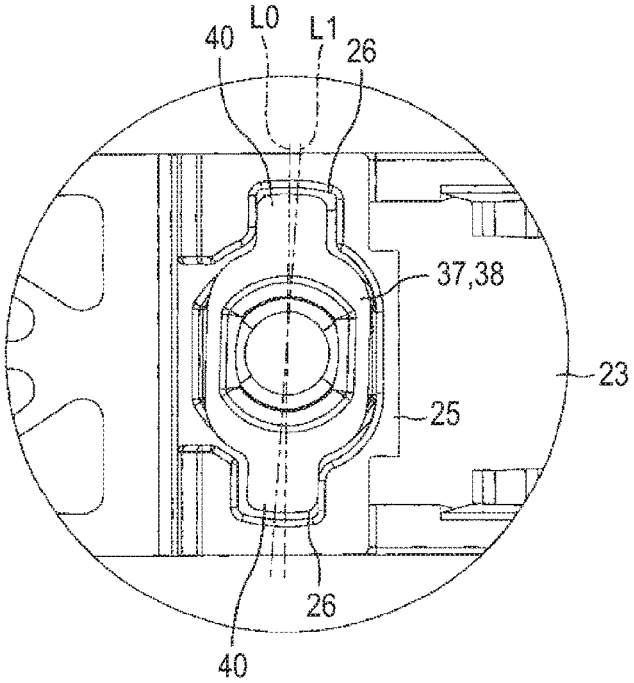
FIG. 3 is an enlarged side view of a panel fixing portion of a handle support member from which a nut is removed, when viewed from the vehicle exterior side.
Figure 4:
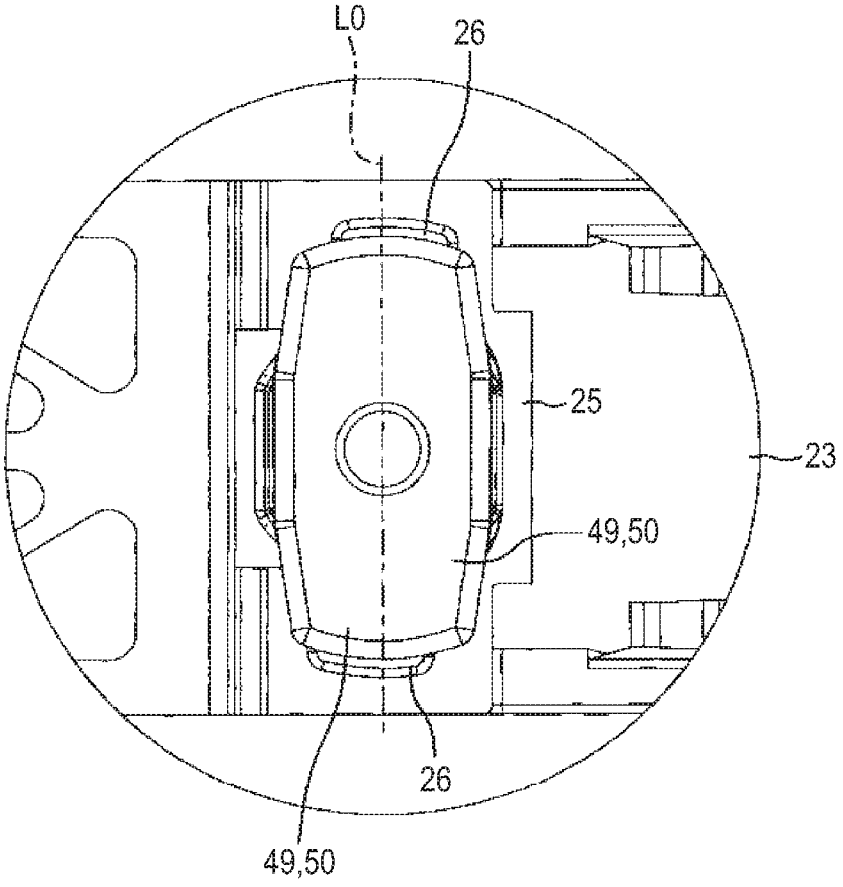
FIG. 4 is an enlarged side view similar to FIG. 3, when the nut is screwed with a bolt.
Figure 5:
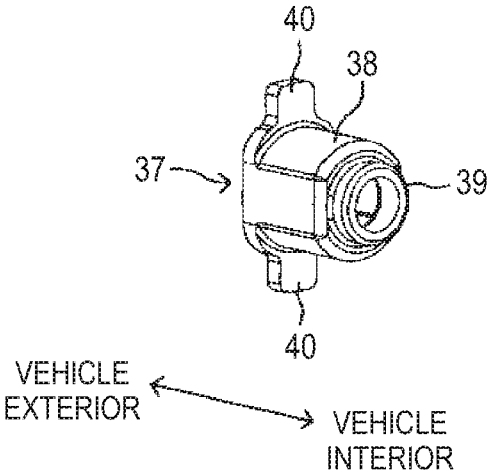
FIG. 5 is a perspective view of the spacer.
Figure 10:
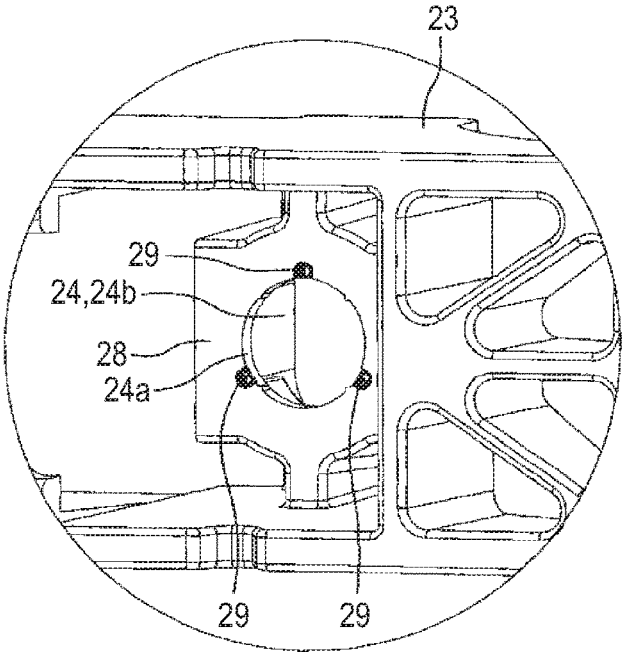
FIG. 10 is an enlarged perspective view of a bolt inserting portion of the handle support member when the bolt is removed.

Portions on a vehicle-exterior-side surface and the vehicle-interior-side surface of the handle support member 23, in which the through-hole 24 is formed, are configured of a panel fixing portion 25 and a bolt inserting portion 28, respectively. As illustrated in FIGS. 2 to 4, a pair of upper and lower recessed portions 26, which are continuous to a vehicle-exterior-side end portion of the main body 24*b*, are formed in the panel fixing portion 25. As illustrated in FIG. 3, a straight line L1 passing through central portions of the upper and lower recessed portions 26 and an axis of the through-hole 24 (main body 24*b*) is tilted by a minute angle with respect to a straight line L0 extending in a perpendicular direction through the axis of the through-hole 24 (main body 24*b*). By comparison, as illustrated in FIG. 10, three protrusions 29 are integrally provided on the bolt inserting portion 28 at equal-angle intervals along a circumferential edge portion of the vehicle-interior-side end portion 24*a* so as to protrude to the vehicle interior side.

Figure 12:
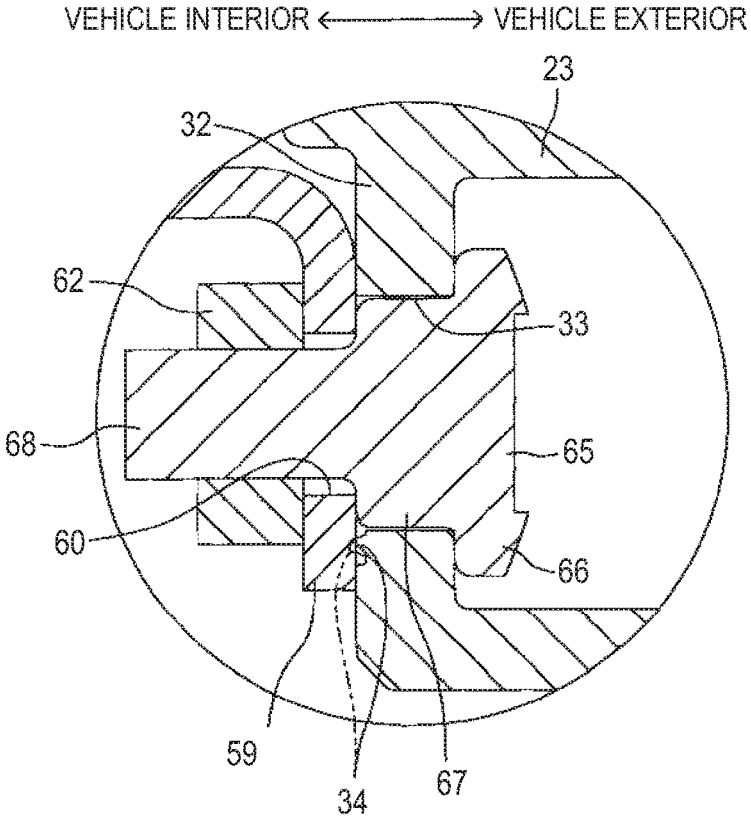
FIG. 12 is a sectional view taken along arrow XII-XII in FIG. 9.

Further, as illustrated in FIGS. 7 and 12, three separated cover-member fixing portions 32 are provided in a rear end portion of the vehicle-interior-side surface of the handle support member 23. As illustrated in the figures, the cover-member fixing portions 32 are flat plate portions orthogonal to the vehicle width direction. Circular bolt inserting holes 33 are formed in the cover-member fixing portions 32, respectively. Three protrusions 34 are integrally provided on vehicle-interior-side surfaces of the cover-member fixing portions 32 at equal-angle intervals along circumferential edge portions of the bolt inserting holes 33.

The spacer 37, the bolt 42, the nut-position regulating member 46, and the nut 49 are detachably attached in the through-hole 24 of the handle support member 23.

The metal spacer 37 is a cylindrical member having an axis coaxial to the through-hole 24. As illustrated in the figures, the spacer 37 integrally has a main body 38, a small-diameter end portion 39 connected to a vehicle-interior-side end portion of the main body 38, and a pair of upper and lower flanges 40 provided on a vehicle-exterior-side end portion of the main body 38. The main body 38 has a non-circular cross section similar to that of the main body 24*b* of the through-hole 24. The small-diameter end portion 39 has a circular cross section that is smaller than the cross sections of the vehicle-interior-side end portion 24*a* and the main body 38.

Figure 6:
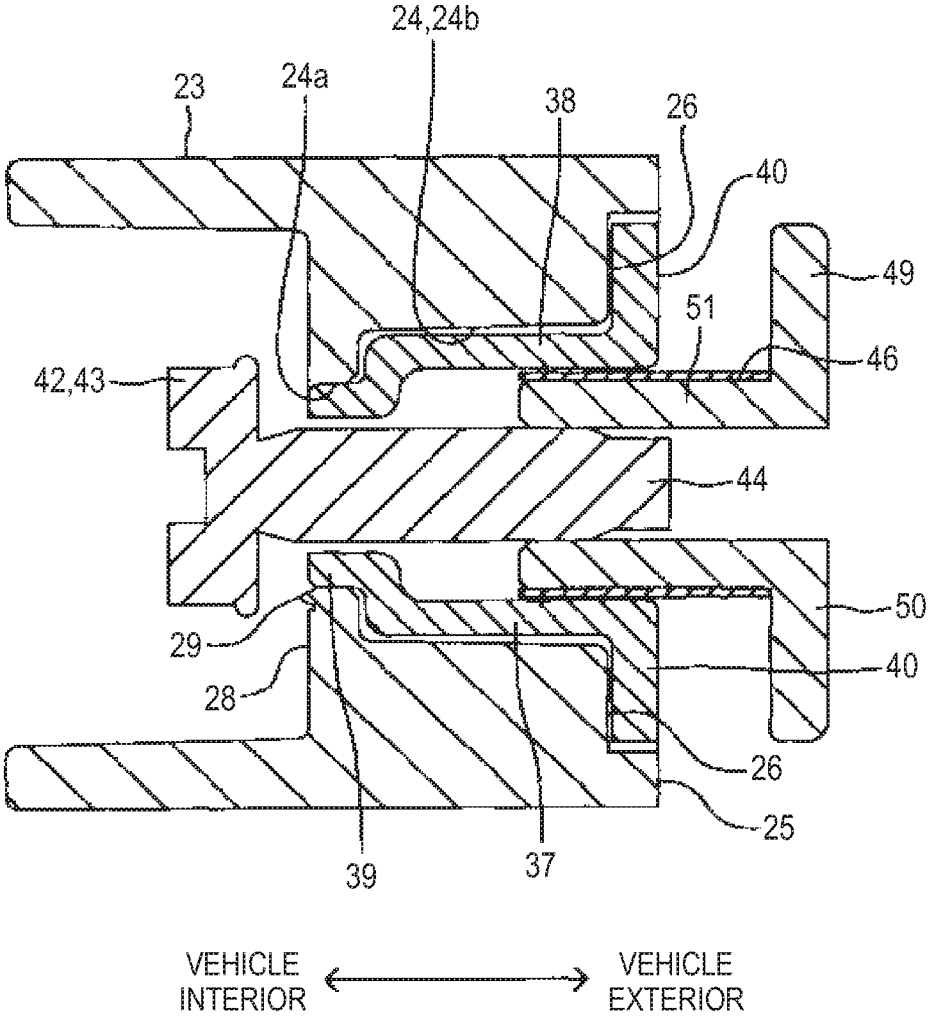
FIG. 6 is an enlarged sectional view obtained by cutting at a position of a through-hole of the outside handle device before the outside handle device is mounted in an outer panel.

As illustrated in FIGS. 3 and 6, the spacer 37 is inserted into the through-hole 24 from the vehicle exterior side of the handle support member 23. Specifically, the main body 38 is positioned in the main body 24*b*, the small-diameter end portion 39 is positioned in the vehicle-interior-side end portion 24*a*, and the pair of flanges 40 are positioned in the upper and lower recessed portions 26. Since the main body 24*b* and the main body 38 have non-circular cross sections, the main body 38 is not able to freely rotate in the main body 24*b*. However, an outer shape of the cross section of the main body 38 is slightly smaller than that of the main body 24*b*, and a width (front-rear dimension) of the flange 40 is narrower than a width of the recessed portion 26. Hence, the main body 38 inserted into the through-hole 24 is able to relatively rotate around the axis of the main body by a minute amount with respect to the handle support member 23 (the through-hole 24 and the recessed portion 26).

The metal bolt 42 integrally has a head portion 43 and a threaded portion 44. The threaded portion 44 has a circular shape having a diameter that is smaller than that of the vehicle-end portion end portion 24*a*. By comparison, the head portion 43 has a circular shape having a diameter that is larger than that of the vehicle-interior-side end portion 24*a*. As illustrated in FIGS. 6 to 8, the threaded portion 44 of the bolt 42 is inserted into the through-hole 24 from the vehicle interior side of the handle support member 23. More specifically, the threaded portion 44 is inserted into inner spaces of the main body 38 and the small-diameter end portion 39 of the spacer 37.

The resin nut-position regulating member 46 is a cylindrical member having an axis coaxial to the through-hole 24. The nut-position regulating member 46 has a non-circular cross section similar to those of the main body 24*b* of the through-hole 24 and the main body 38 of the spacer 37. Further, multiple ribs 47 extending in a direction parallel to the axis of the nut-position regulating member 46 are provided to protrude from an outer circumferential surface of the nut-position regulating member at equal-angle intervals in a circumferential direction.

As illustrated in FIG. 6, the nut-position regulating member 46 is inserted into an inner space of the spacer 37 disposed in the through-hole 24 from the vehicle exterior side of the handle support member 23. When the nut-position regulating member 46 is inserted into the inner space of the spacer 37, the ribs 47 on the outer circumferential surface of the nut-position regulating member 46 are subjected to the elastic deformation and come into press contact with the inner circumferential surface of the spacer 37. Hence, when the nut-position regulating member 46 is inserted into the inner space of the spacer 37, relative rotation of the spacer 37 and the nut-position regulating member 46 is practically regulated, and a relative position of the nut-position regulating member 46 is temporarily maintained with respect to the spacer 37. However, a force in an axial direction of the nut-position regulating member 46, which acts on the nut-position regulating member 46, causes the nut-position regulating member 46 to slide through the inner circumferential surface of the spacer 37.

The metal nut 49 integrally has a head portion 50 and a shaft portion 51. A size of the head portion 50 of the nut 49 in a longitudinal direction is longer than an inner diameter of the main body 38 of the spacer 37. The shaft portion 51 has a non-circular cross section similar to those of the main body 24*b* of the through-hole 24, the main body 38 of the spacer 37, and the nut-position regulating member 46.

As illustrated in FIGS. 4 and 6, the shaft portion 51 of the nut 49 is inserted into the inner space of the main body 38 of the spacer 37 from the vehicle exterior side of the handle support member 23, and is screwed with the threaded portion 44 of the bolt 42 in the inner space.

The movement of the nut 49 to the handle support member 23 side is regulated at a position at which the head portion 50 comes into contact with a vehicle-exterior-side end portion of the nut-position regulating member 46.

Since both of the nut-position regulating member 46 and the shaft portion 51 have non-circular cross sections, the shaft portion 51 is not able to freely rotate in the nut-position regulating member 46. However, the cross section of the shaft portion 51 has a slightly smaller size than the cross section of the inner space of the nut-position regulating member 46. Hence, the shaft portion 51 inserted into the nut-position regulating member 46 is able to relatively rotate around the shaft portion by a minute amount with respect to the nut-position regulating member 46 (and the spacer 37).

Before the outside handle device 20 is attached to the outer panel 12, the spacer 37, the bolt 42, the nut-position regulating member 46, and the nut 49 are integrated with the handle support member 23.

As illustrated in FIG. 6, in a state before the outside handle device 20 is attached to the outer panel 12, first, the vehicle-exterior-side end portion of the nut-position regulating member 46 and the head portion 50 of the nut 49 are positioned on the vehicle exterior side from the vehicle-exterior-side surface of the handle support member 23 and the flange 40 of the spacer 37. In other words, a gap having a certain size, that is, a dimension larger than a thickness of the outer panel 12, is formed between the head portion 50 of the nut 49 and the panel fixing portion 25 of the handle support member 23.

As illustrated in FIGS. 2, 7, and 8, a pair of upper and lower handle support arms 54 are supported on both upper and lower surfaces of a front end portion of the handle support member 23. Specifically, one-side ends of the upper and lower handle support arms 54 are rotatably supported by the handle support member 23 via a rotary shaft 55 extending in the vertical direction.

It is possible to attach and detach, to and from the other-side ends of the upper and lower handle support arms 54, a connection portion (not illustrated) provided to protrude from a front end portion of the vehicle-interior-side surface of the outside handle 21.

Figure 9:
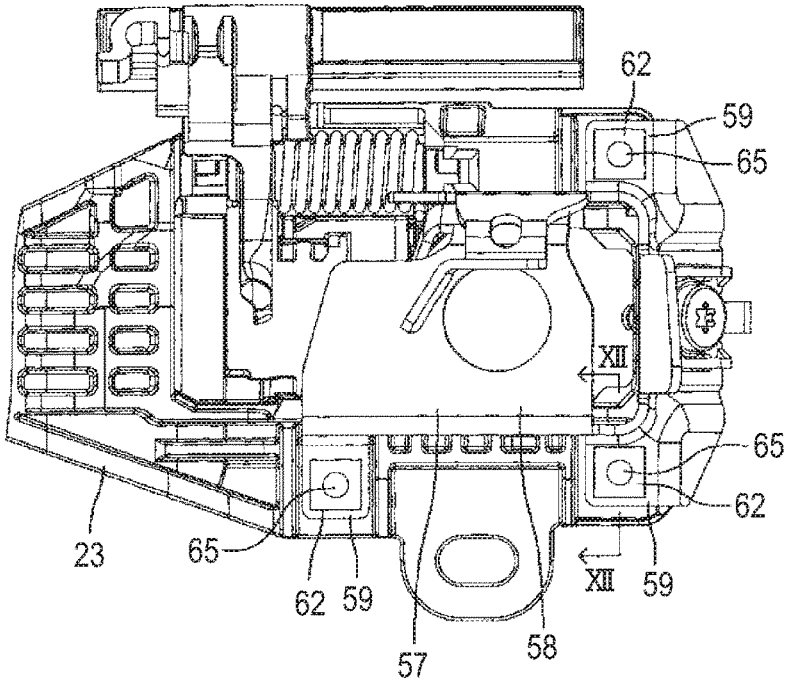
FIG. 9 is a side view of a rear part of the outside handle device when viewed from a vehicle interior side.

As illustrated in FIGS. 8 and 9, the metal cover member 57 is provided in a rear end portion of the vehicle-interior-side surface of the handle support member 23.

Figure 11:
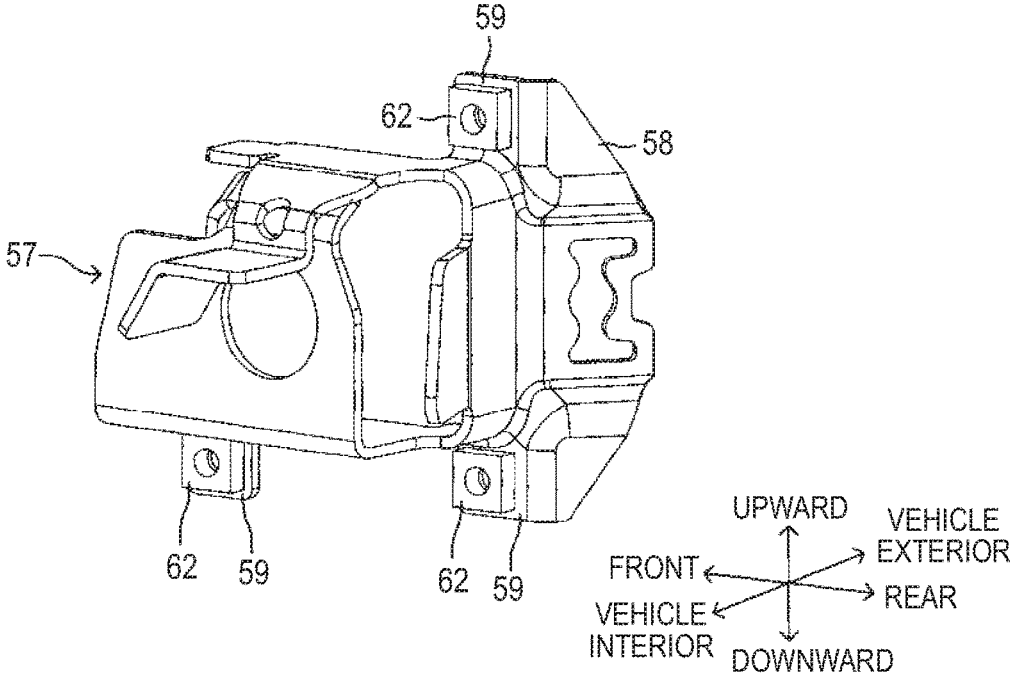
FIG. 11 is a perspective view of the cover member.

As illustrated in FIG. 11, the cover member 57 integrally includes three metal nuts 62 and a cover main body 58 as a press-formed product of a metal plate.

The cover main body 58 includes three nut support portions 59. As illustrated in the figures, the nut support portions 59 are flat plate portions orthogonal to the vehicle width direction. Circular bolt inserting holes 60 are formed in the nut support portions 59, respectively.

The nuts 62 are fixed on vehicle-interior-side surfaces of the nut support portions 59 by projecting welding. As illustrated in FIG. 12, an internally-threaded hole of the nut 62 has an axis coaxial to the bolt inserting hole 60 of the corresponding nut support portion 59. As illustrated in the figures, the bolt inserting hole 60 has a smaller diameter than the bolt inserting hole 33, and the internally-threaded hole of the nut 62 has a smaller diameter than the bolt inserting hole 60.

The vehicle-exterior-side surfaces of the three nut support portions 59 cover three cover-member fixing portions 32 of the handle support member 23 from the vehicle interior side, respectively, and metal bolts 65, which are inserted into the bolt inserting hole 33 from the vehicle exterior side of the cover-member fixing portions 32 and penetrate through the bolt inserting holes 60 of the nut support portions 59, are screwed with the nuts 62. In this manner, the cover member 57 is fixed to the handle support member 23.

Figure 13A:
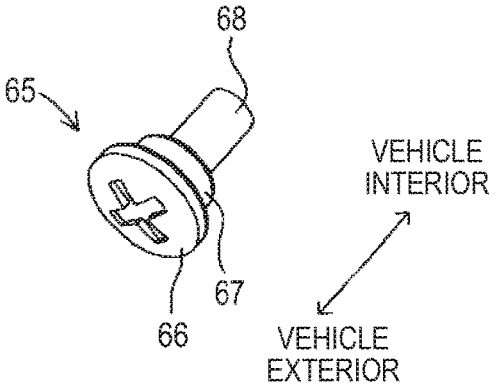
FIG. 13A is a perspective view of the bolt when viewed from the vehicle exterior side.
Figure 13B:
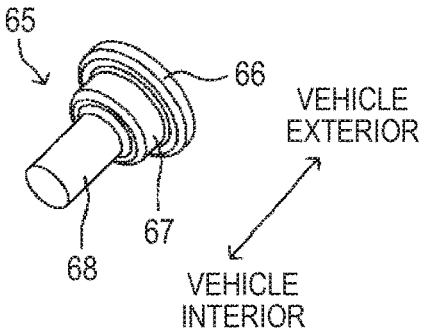
FIG. 13B is a perspective view of the bolt when viewed from the vehicle interior side.

As illustrated in FIGS. 12 to 13B, the bolt 65 integrally has a head portion 66, a spacer portion 67 extending from the head portion 66 to the vehicle interior side, and a threaded portion 68 extending from the spacer portion 67 to the vehicle interior side. The head portion 66 has an outer diameter that is larger than the diameter of the bolt inserting hole 33. The spacer portion 67 has an outer diameter that is smaller than the diameter of the head portion 66 and the diameter of the bolt inserting hole 33 and is larger than the diameter of the bolt inserting hole 60. Further, a dimension (except the protrusion 34) of the spacer portion 67 in the vehicle width direction is slightly larger than a thickness (dimension in the vehicle width direction) of the cover-member fixing portion 32 (however, is slightly smaller than the thickness of the cover-member fixing portion 32 including the protrusion 34). The threaded portion 68 has an outer diameter that is smaller than the diameter of the spacer portion 67 and the diameter of the bolt inserting hole 60.

As illustrated in FIG. 12, when the threaded portion 68 of the bolt 65 is screwed with the corresponding nut 62 and an amount of screwing of the threaded portion 68 of the bolt 65 with the nut 62 is increased, an axial force (fastening force) produced between the bolt 65 and the nut 62 causes an outer circumferential portion (portion positioned on an outer circumferential side of the threaded portion 68) of the vehicle-interior-side surface of the spacer portion 67 to come into press contact with the vehicle-exterior-side surface of the nut support portion 59. Hence, a distance between the nut support portion 59 and the head portion 66 in the vehicle width direction is maintained to be a constant distance. Further, as illustrated in FIG. 12, since the vehicle-exterior-side surface of the cover-member fixing portion 32 comes into press contact with the head portion 66 and the nut support portion 59 comes into press contact with the protrusions 34 provided to protrude from the vehicle-interior-side surface of the cover-member fixing portions 32, (a portion, which is indicated by a two-dot chain line in FIG. 12, of) the protrusions 34 are crushed (are subjected to plastic deformation) against the nut support portion 59. Hence, the cover-member fixing portions 32 (and the protrusions 34) are sandwiched between the head portions 66 of the bolts 65 and the nut support portions 59 of the cover member 57. Hence, the nut support portions 59 of the cover member 57 are firmly fixed to the cover-member fixing portions 32 of the handle support member 23.

The outside handle device 20 having the above configuration is fixed to the outer panel 12 in a state in which the outside handle 21 is detached from the handle support arm 54.

Figure 14:
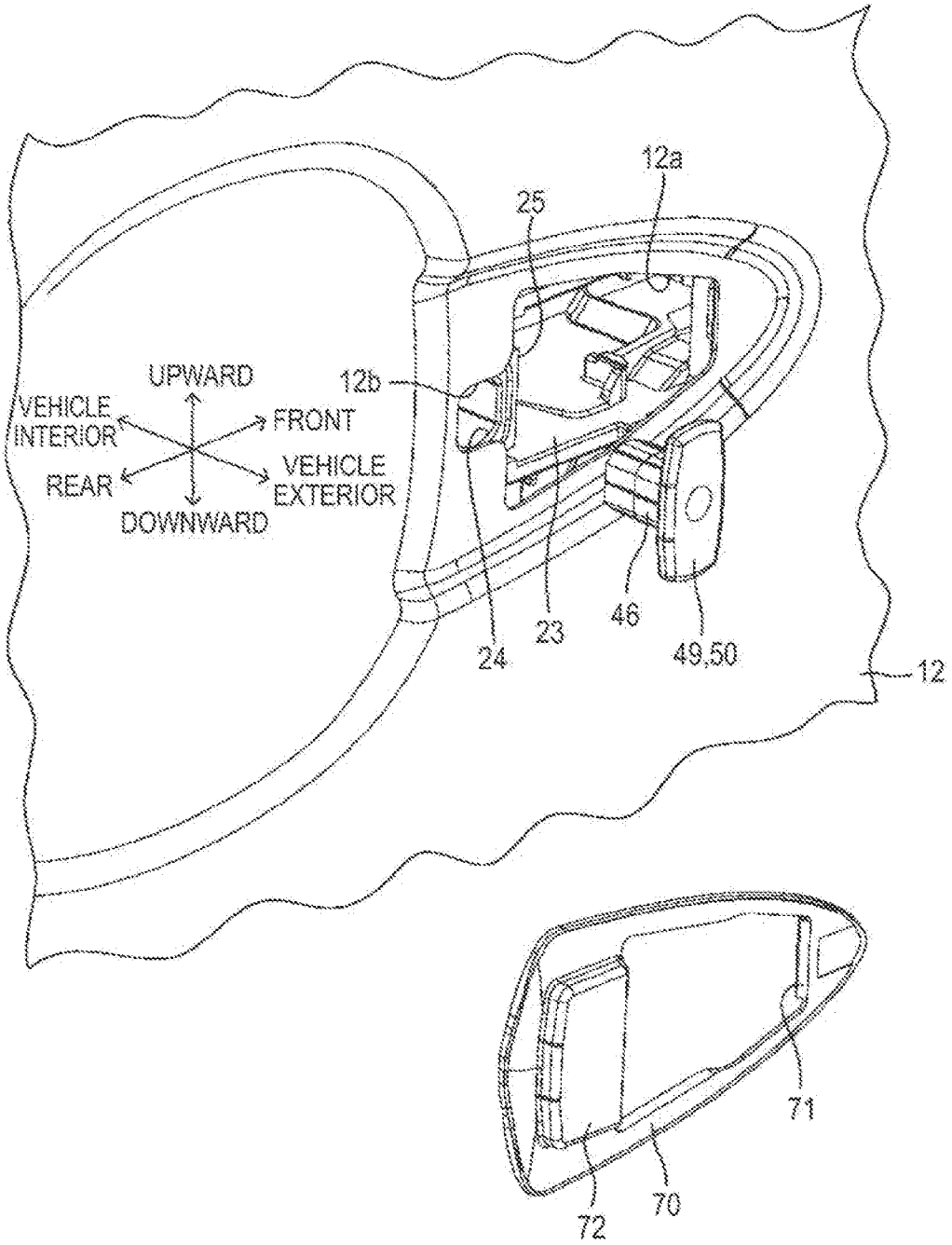
FIG. 14 is a perspective view of a separated state of the outer panel, the nut, and the cover member which are disposed on the vehicle exterior side of the handle support member, when viewed from the vehicle exterior side.
Figure 15:
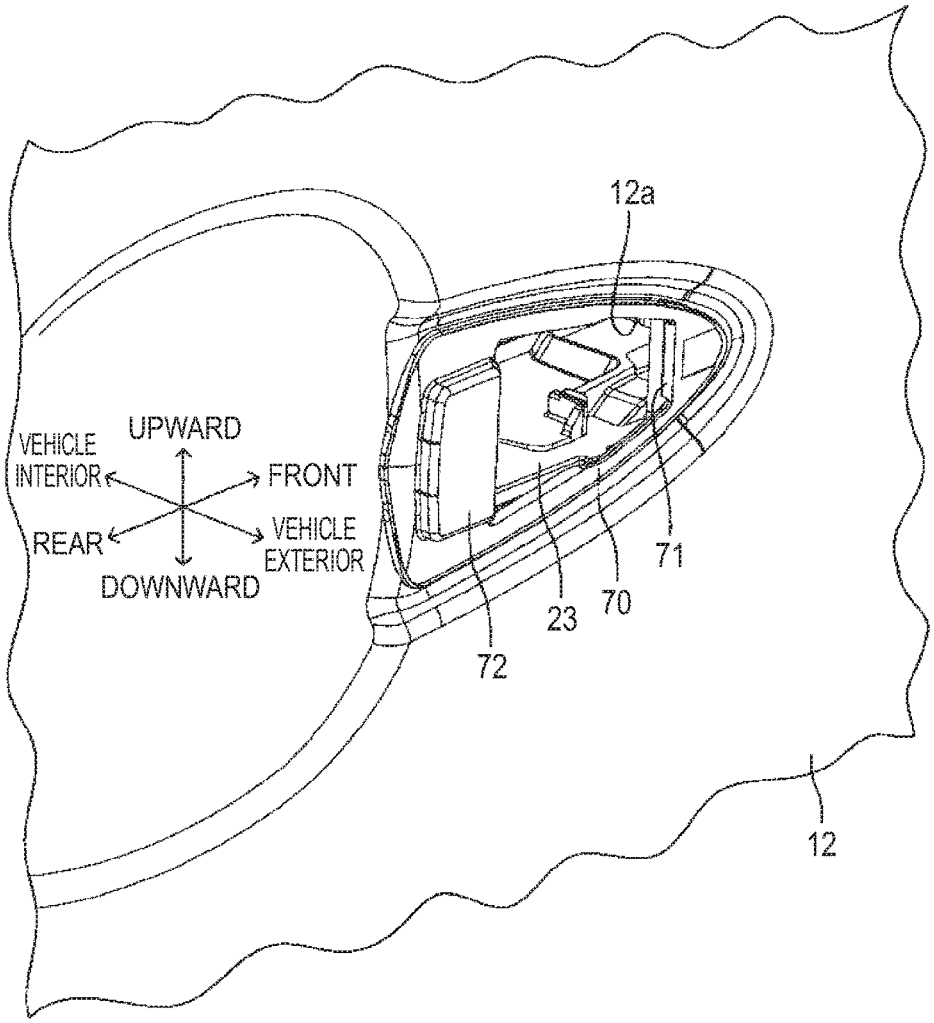
FIG. 15 is a perspective view similar to FIG. 14, when the nut is mounted in the handle support member and the cover member is mounted on the outer panel.

As illustrated in FIGS. 14 and 15, a handle attaching hole 12*a* is formed as a through-hole in the outer panel 12. Further, a bolt inserting hole 12*b* is formed in a rear portion on an inner circumferential edge of the handle attaching hole 12*a*. The bolt inserting hole 12*b* is a hole that penetrates through the outer panel 12 in a thickness direction thereof and is continuous to the handle attaching hole 12*a*.

When the outside handle device 20 is attached to the outer panel 12, first, the outside handle device 20 (in which the outside handle 21 is not mounted) is caused to face the vehicle-interior-side surface of the outer panel 12, and the head portion 50 of the nut 49 is positioned on the vehicle exterior side of the outer panel 12 through the handle attaching hole 12*a*.

Subsequently, the entire outside handle device 20 is caused to slide to the rear side with respect to the outer panel 12, and thereby the vehicle-exterior-side portion of the nut-position regulating member 46 and the vehicle-exterior-side portion of the shaft portion 51 of the nut 49 that project from the vehicle-exterior-side surface (the through-hole 24) of the panel fixing portion 25 to the vehicle exterior side are loosely fitted in the bolt inserting hole 12*b* from front.

Then, in this state, the bolt 42 of the outside handle device 20 is caused to relatively rotate with respect to the nut 49 in a counterclockwise direction (fastening direction) in FIG. 3, by using a driver or the like from the vehicle interior side of the outer panel 12. The relative rotation of the bolt with respect to the through-hole 24 of the spacer 37 is regulated to be performed within a predetermined range by the recessed portion 26 and the flange 40, and the relative rotation of the nut 49 with respect to the nut-position regulating member 46 (spacer 37) is also regulated to be performed within a predetermined range. Therefore, when the bolt 42 is caused to rotate by a driver or the like, an amount of screwing of the threaded portion 44 of the bolt 42 with the shaft portion 51 of the nut 49 gradually increases and a distance between the head portion 43 and the head portion 50 in the vehicle width direction gradually decreases, without regulation of the rotation of the nut 49 by hand or the like.

Figure 16:
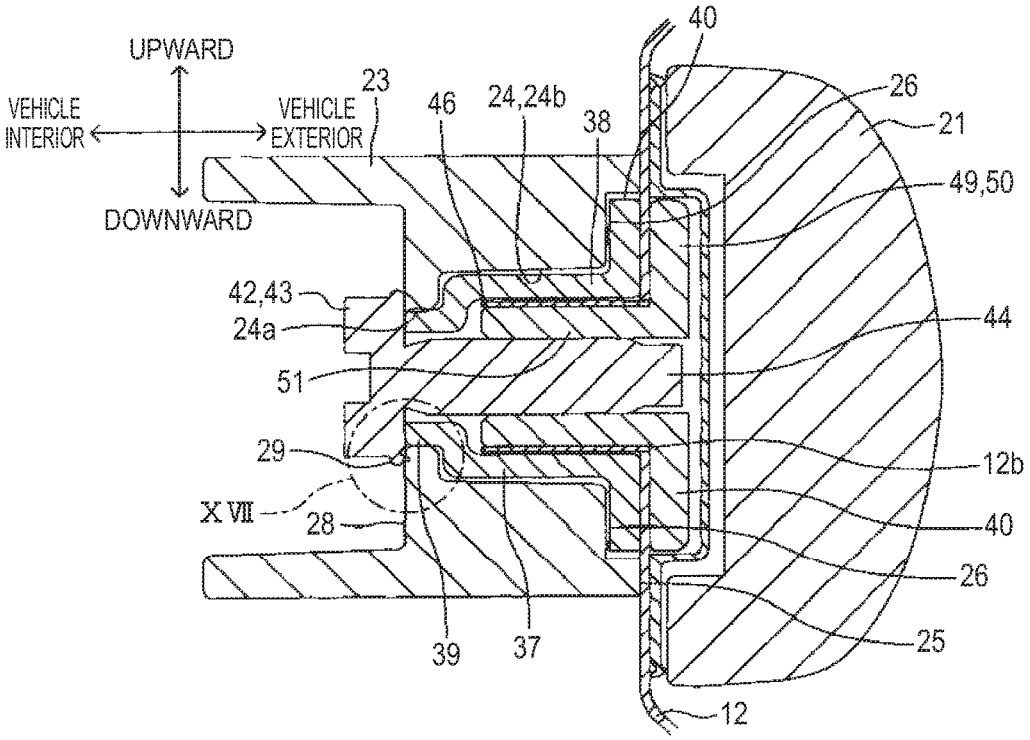
FIG. 16 is a sectional view illustrating the outer panel and the outside handle device that are fixed to each other, similarly to FIG. 6.
Figure 17:
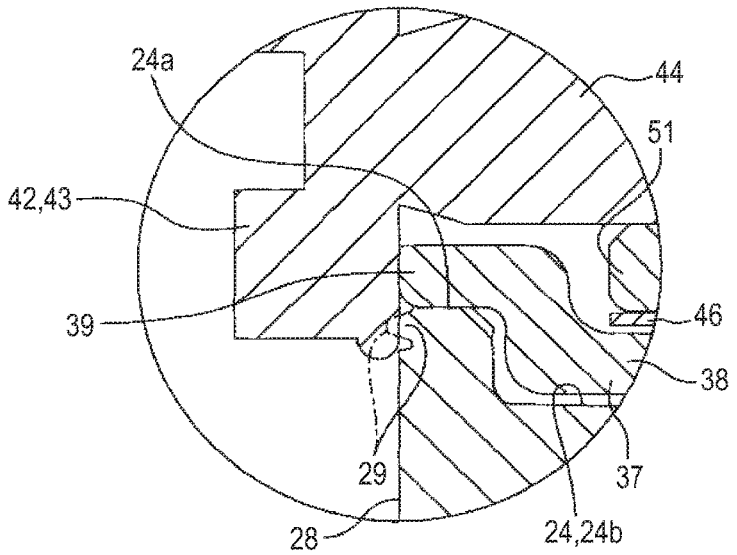
FIG. 17 is an enlarged view of portion XVII in FIG. 16.
Figure 18:
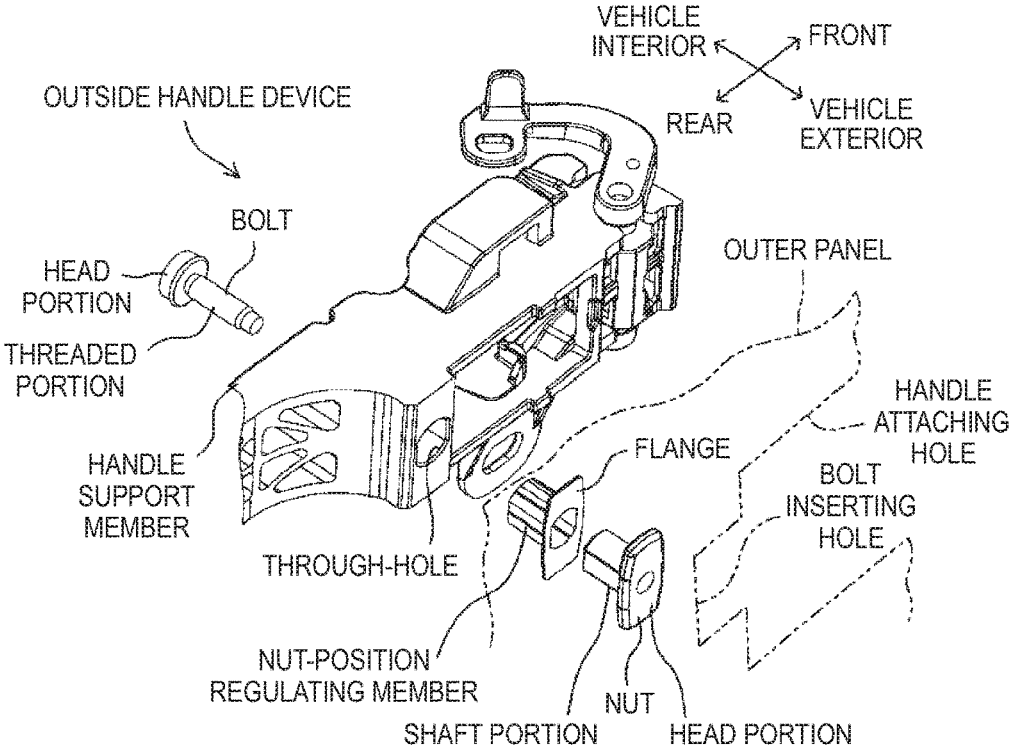
FIG. 18 is a perspective view illustrating a comparative example, similarly to FIG. 2.
Figure 19:
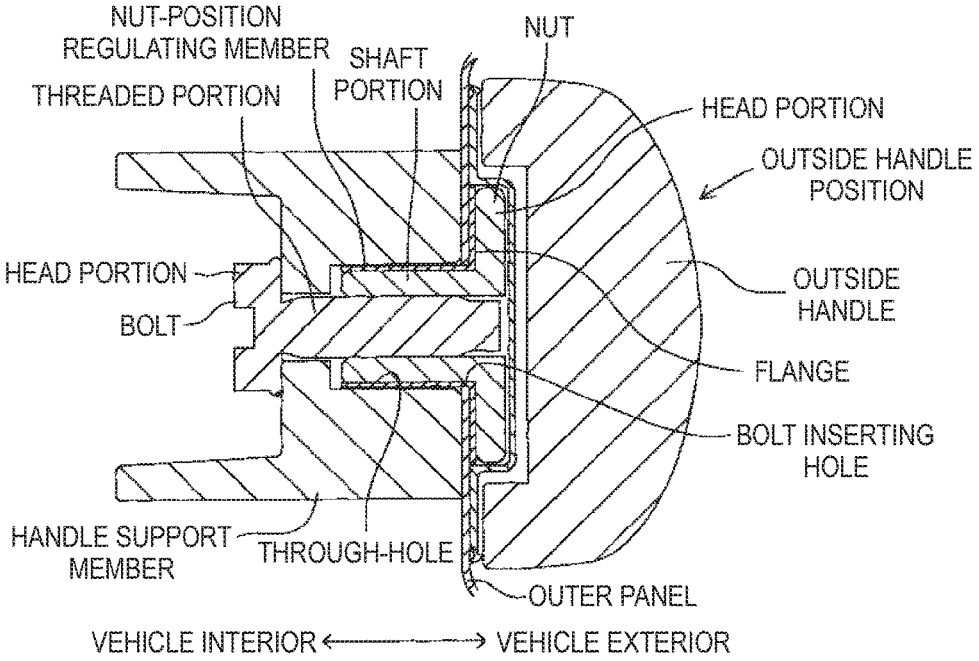
FIG. 19 is a sectional view illustrating the comparative example, similarly to FIG. 16.

Therefore, as illustrated in FIG. 16, when the amount of screwing of the threaded portion 44 with the shaft portion 51 reaches a predetermined amount, the axial force of the bolt 42 and the nut 49 causes the outer panel 12 to be sandwiched between the head portion 50 of the nut 49 and the vehicle-exterior-side end surface (flange 40) of the spacer 37 and causes the end surface of the small-diameter end portion 39 of the spacer 37 to come into press contact with the head portion 43 of the bolt 42. As a result, a distance between the flange 40 of the spacer 37 and the head portion 43 of the bolt 42 in the vehicle width direction is maintained to be a constant distance. At this time, the vehicle-interior-side end surface of the small-diameter end portion 39 slightly further projects to the vehicle interior side than the panel fixing portion 25. However, a front end of the protrusion 29 is positioned to the vehicle interior side from the vehicle-interior-side surface of the small-diameter end portion 39. Further, as illustrated in FIG. 17, since the head portion 43 of the bolt 42 comes into press contact with the protrusions 29 protruding from the bolt inserting portion 28, (a portion, which is indicated by a two-dot chain line in FIG. 17, of) the protrusions 29 are crushed (are subjected to the plastic deformation) against the head portion 43. However, the head portion 43 does not come into contact with the bolt inserting portion 28. Further, the panel fixing portion 25 of the handle support member 23 comes into contact with the outer panel 12. Hence, the handle support member 23 and the protrusions 29 are sandwiched between the outer panel 12 and the head portion 43 of the bolt 42. Hence, the handle support member 23 is firmly fixed to the outer panel 12.

Further, after the amount of screwing of the threaded portion 44 with the shaft portion 51 reaches the predetermined amount, the nut 49 slightly rotates in the counterclockwise direction in FIGS. 3 and 4 and the outer circumferential surface of the shaft portion 51 comes into press contact with the nut-position regulating member 46 integrated with the spacer 37 when the bolt 42 is caused to slightly rotate in the counterclockwise direction in FIG. 3. Therefore, the relative rotation of the nut 49, the nut-position regulating member 46, and the spacer 37 in the counterclockwise direction in FIG. 3 is regulated.

From this state, when the bolt 42 is caused to slightly rotate in the counterclockwise direction in FIG. 3, the spacer 37 rotates in the counterclockwise direction in FIG. 3 along with the bolt 42, the nut 49, and the nut-position regulating member 46, and the relative rotation of the flange 40 with respect to the recessed portion 26 (handle support member 23) of the spacer 37 is regulated when the upper and lower flanges 40, which relatively rotate with respect to the corresponding recessed portion 26, come into contact with the inner circumferential surface of the recessed portion 26.

FIGS. 3 and 4 illustrate states of the spacer 37 and the nut 49 when the relative rotation of the flange 40 with respect to the recessed portion 26 (handle support member 23) of the spacer 37 is regulated. As illustrated in Figures, at this time, a straight line passing through central portions of the upper and lower flanges 40 and the axis of the main body 38 and a straight line extending in the longitudinal direction of the head portion 50 through the central portion of the head portion 50 match the straight line L0 extending in the perpendicular direction through the axis of the through-hole 24 (main body 24*b*). In other words, before or at the time when the amount of screwing of the threaded portion 44 with the shaft portion 51 reaches the predetermined amount, eventually the straight line passing through the central portions of the upper and lower flanges 40 and the axis of the main body 38 and the straight line extending in the longitudinal direction of the head portion 50 through the central portion of the head portion 50 match the straight line L0 (that is, the perpendicular direction), even when the straight line passing through the central portions of the upper and lower flanges 40 and the axis of the main body 38 and the straight line extending in the longitudinal direction of the head portion 50 through the central portion of the head portion 50 match the straight line L1 that is tilted with respect to the straight line L0.

When the handle support member 23 is fixed to the outer panel 12 in this manner, a resin outside cover 70 illustrated in FIGS. 14 and 15 is mounted to the outer panel 12 from the vehicle exterior side.

As illustrated in the figures, a handle attaching hole 71 having a shape similar to that of the handle attaching hole 12*a* is formed at the central portion of the outside cover 70.

Further, a recessed-portion forming portion 72 is provided to project from a vehicle-exterior-side surface of the outside cover 70. A head-portion accommodating recess portion, which has substantially the same shape as the head portion 50 of the nut 49 and which is not illustrated, is formed on the vehicle-interior-side surface of the recessed-portion forming portion 72. The axis of the head-portion accommodating recess portion in the longitudinal direction thereof extends in the perpendicular direction.

In the state in which the straight line passing through the central portions of the upper and lower flanges 40 and the axis of the main body 38 matches the straight line L0, the outside cover 70 covers a portion in which the handle attaching hole 12*a* and the bolt inserting hole 12*b* of the outer panel 12 are formed and the outside cover 70 is fixed to the outer panel 12. Then, the nut 49 is covered with the recessed-portion forming portion 72 of the outside cover 70 and further, the head portion 50 of the nut 49 is smoothly accommodated in the head-portion accommodating recess portion of the outside cover 70.

In this manner, when the outside handle device 20 (in which the outside handle 21 is not mounted) is fixed to the outer panel 12, the connection portion, which is provided to project from the front end portion of the outside handle 21 positioned on the vehicle exterior side of the outer panel 12, is positioned on the vehicle interior side of the outer panel 12 through the handle attaching holes 12*a* and 71, and the connection portion is connected to the other-side ends of the upper and lower handle support arms 54 on the vehicle interior side of the outer panel 12. Then, the outside handle 21 can relatively rotate along with the handle support arms 54 with respect to the handle support member 23. In other words, the outside handle 21 can relatively rotate with respect to the handle support member 23 between the initial position and the operational position.

Since the handle support member 23, which supports the outside handle 21 in a rotatable manner, is firmly fixed to the outer panel 12, it is possible to perform the rotational operation in the state in which the outside handle 21 is stable with respect to the handle support member 23.

Note that, as known in the related art, the outside handle 21 is linked to the locking device 13 through a plurality of linkage members. As described above, when the outside handle 21 is caused to rotate between the initial position and the operational position, the locking device 13 switches between the latched state and the unlatched state.

As described above, when the handle support member 23 is fixed to the outer panel 12 by using the bolt 42 and the nut 49, the distance between the flange 40 of the spacer 37 and the head portion 43 of the bolt 42 in the vehicle width direction is maintained to be the constant distance, and the spacer 37 and the outer panel 12 are sandwiched between the flange 40 and the head portion 43. In other words, while both of the metal spacer 37 and the metal outer panel 12 are sandwiched between both of the metal bolt 42 and the metal nut 49, the bolt and nut exert an axial force on the spacer and the panel. In addition, since the spacer 37 has a cylindrical body, the spacer has great stiffness against the compression in an axial direction. Therefore, since creep is unlikely to occur (the plastic deformation is unlikely to occur) in the spacer 37 although the outside handle device 20 is increased in temperature or time elapses, the axial force exerted from the bolt 42 and the nut 49 is unlikely to be decreased.

Hence, the handle support member 23 is sandwiched between the outer panel 12 and the head portion 43 of the bolt 42, and thereby it is possible to firmly fix the handle support member 23 to the outer panel 12 over a long period of time.

In addition, in the embodiment, the protrusion 29 is provided to protrude from the bolt inserting portion 28 of the handle support member 23 and the protrusion 29 is crushed (is subjected to the plastic deformation) against the head portion 43 of the bolt 42. In this manner, the handle support member 23 (protrusion 29) is sandwiched between the outer panel 12 and the head portion 43 of the bolt 42. Therefore, compared to a case where the protrusion 29 is not provided, it is easy to sandwich the spacer 37 between the outer panel 12 and the head portion 43 and to sandwich the handle support member 23 between the outer panel 12 and the head portion 43.

A configuration, in which the spacer 37 and the handle support member 23 are integrated with each other through the insert molding or the heat welding such that the vehicle-interior-side surface of the spacer 37 and (the surface of) the bolt inserting portion 28 of the handle support member 23 have the same completely flat surface, is considered to be employed. In this configuration, without forming the protrusion 29 on the handle support member 23, it is possible to sandwich the spacer 37 between the outer panel 12 and the head portion 43 and to easily sandwich the handle support member 23 between the outer panel 12 and the head portion 43. However, manufacturing costs of the outside handle device 20 are likely to be increased by using the insert molding and the heat welding. In other words, in the embodiment, it is possible to decrease the manufacturing costs of the outside handle device 20.

Note that a fixing structure of the cover member 57 to the handle support member 23 is the same as a fixing structure of the handle support member 23 to the outer panel 12.

In other words, as illustrated in FIG. 12, when the cover member 57 is fixed to the handle support member 23, the distance between the nut support portion 59 of the cover member 57 and the head portion 66 of the bolt 65 in the vehicle width direction is maintained to be the constant distance, and the cover-member fixing portion 32 of the handle support member 23 is sandwiched between the nut support portion 59 and the head portion 66. In other words, while the metal spacer portion 67 is sandwiched between both of the metal nut support portion 59 and head portion 66, an axial force is applied to the spacer. Therefore, since creep is unlikely to occur (the plastic deformation is unlikely to occur) in the spacer portion 67 although the outside handle device 20 is increased in temperature or time elapses, the axial force exerted from the bolt 65 and the nut 62 is unlikely to be decreased.

In addition, the protrusion 34, which is crushed (is subjected to the plastic deformation) against the nut support portion 59, is provided to protrude from the cover-member fixing portion 32.

Hence, also regarding the fixing structure of the cover member 57 to the handle support member 23, it is possible to expect effects similar to the effects achieved from the fixing structure of the handle support member 23 to the outer panel 12.

Further, the gap having a larger size than the thickness of the outer panel 12 is formed, by the nut-position regulating member 46, between the head portion 50 of the nut 49 and the panel fixing portion 25 of the handle support member 23 of the outside handle device 20 in the state before the outside handle device is attached to the outer panel 12.

Hence, it is possible to easily perform an operation of fixing the outside handle device 20 to the bolt inserting hole 12*b* of the outer panel 12.

As described above, since the axis of the head-portion accommodating recess portion of the outside cover 70 in the longitudinal direction extends in the perpendicular direction, the straight line extending through the central portion of the head portion 50 in the longitudinal direction of the head portion 50 needs to match the straight line L0 when the handle support member 23 is fixed to the outer panel 12 by using the bolt 42 and the nut 49.

In theory, the inner circumferential surface of the through-hole 24 (main body 24*b*) formed in the handle support member 23 and the outer circumferential surface of the main body 38 of the spacer 37 can have the completely same non-circular cross section, and the outer circumferential surface of the shaft portion 51 of the nut 49 and the inner circumferential surface of the nut-position regulating member 46 can have the completely same non-circular cross section. In this manner, when the bolt 42 is caused to rotate in the fastening direction by using a driver or the like from the vehicle interior side of the outer panel 12, it is possible to reliably screw the bolt 42 with the nut 49 without regulating the rotation of the nut 49 by hand or the like. Further, after the handle support member 23 is fixed to the outer panel 12 by using the bolt 42 and the nut 49, the straight line extending through the central portion of the head portion 50 in the longitudinal direction of the head portion 50 matches the straight line L0. However, it is very difficult to manufacture the through-hole 24 (main body 24*b*) of the handle support member 23, the spacer 37, the nut-position regulating member 46, and the nut 49 (shaft portion 51) having such shapes, which can be (easily) attached and detached to and from each other.

Therefore, in the embodiment, even when the inner circumferential surface of the through-hole 24 (main body 24*b*), the outer circumferential surface of the main body 38 of the spacer 37, the outer circumferential surface of the shaft portion 51 of the nut 49, and the inner circumferential surface of the nut-position regulating member 46 have non-circular cross sections, sizes of the adjacent members having the non-circular shape are changed from each other. Therefore, it is easy to attach and detach the through-hole 24, the spacer 37, the nut-position regulating member 46, and the nut 49 in the embodiment to and from each other, it is possible to reliably screw the bolt 42 with the nut 49 without regulating the rotation of the nut 49 by hand or the like when the bolt 42 is caused to rotate in the fastening direction by using a driver or the like from the vehicle interior side of the outer panel 12.

However, in the case where the sizes of the non-circular shapes of the adjacent member are changed from each other, in general, there is a concern that the straight line extending through the central portion of the head portion 50 in the longitudinal direction of the head portion 50 will not be formed in a desirable direction when the handle support member 23 is fixed to the outer panel 12 by using the bolt 42 and the nut 49.

However, in the embodiment, after the handle support member 23 is fixed to the outer panel 12 by using the bolt 42 and the nut 49, the slight rotation of the bolt 42 in the counterclockwise direction in FIG. 3 causes the outer circumferential surface of the shaft portion 51 to come into contact with the inner circumferential surface of the nut-position regulating member 46 integrated with the spacer 37 and causes the pair of flanges 40 of the spacer 37 to come into contact with the inner circumferential surfaces of the pair of the recessed portions 26. Then, in such a contact state, the shapes of the cross section of the through-hole 24, the spacer 37, the nut-position regulating member 46, and the nut 49 are set such that the straight line extending through the central portion of the head portion 50 in the longitudinal direction of the head portion 50 is parallel to the straight line L0. Hence, when the handle support member 23 is fixed to the outer panel 12 by using the bolt 42 and the nut 49, it is possible to reliably direct the straight line extending through the central portion of the head portion 50 in the longitudinal direction of the head portion 50 toward the direction of the straight line L0.

Further, the small-diameter end portion 39 of the spacer 37 has a smaller diameter than the main body 38, and thereby the protrusions 29 provided in the bolt inserting portion 28 are to approach the small-diameter end portion 39, when viewed in an axial direction (vehicle width direction) of the bolt 42. In other words, the diameter of the circle passing through the three protrusions 29 is decreased.

Therefore, compared to a case where the small-diameter end portion 39 is not provided in the spacer 37, it is possible to decrease the size of the head portion 43 that has a function of crushing the three protrusions 29.

As described above, the embodiments disclosed here are described; however the invention is not limited to the embodiments described above.

For example, the spacer 37 may have a shape other than the cylinder.

The number of the protrusions 29 that are provided in the bolt inserting portion 28 may be one or may be three or more. Similarly, the number of the protrusions 34 that are provided in the cover-member fixing portion 32 may be one or may be three or more.

The cover member 57 that has the cover main body 58 and the nut 62 may be integrally molded of a metal plate through press molding.

When the protrusions 29 are omitted from the handle support member 23 and the spacer 37 is sandwiched between the outer panel 12 and the head portion 43, the bolt inserting portion 28 of the handle support member 23 may come into contact with the head portion 43. Similarly, when the protrusions 34 are omitted from the handle support member 23 and the spacer portion 67 is sandwiched between the head portion 66 of the bolt 65 and the nut support portion 59 of the cover member 57, the cover-member fixing portion 32 of the handle support member 23 may come into contact with the nut support portion 59.

The nut-position regulating member 46 may be omitted from the outside handle device 20.

The embodiment disclosed here may be applied to an inside handle device.

The embodiment disclosed here may be applied to a sliding-type vehicle door.

An aspect of this disclosure is directed to a vehicle handle device including: a resin handle support member having one surface in a vehicle width direction which faces one surface of a metal panel of a vehicle door; a handle that is rotatably supported by the handle support member and causes, through rotating thereof, a locking device provided in the vehicle door to perform a transition from a latched state to an unlatched state; a metal bolt that penetrates through a through-hole penetrating through the handle support member in the vehicle width direction, that penetrates through a bolt inserting hole formed in the panel so as to be relatively movable in the vehicle width direction, and that has a head portion facing the other surface of the handle support member in the vehicle width direction; a metal nut that faces the other surface of the panel and is screwed with the bolt; and a metal spacer which is positioned between the head portion and the other surface of the panel, and whose both end portions in the vehicle width direction come into contact with the head portion and the one surface of the panel, respectively, when the head portion comes into contact with the other surface of the handle support member and the nut comes into contact with the other surface of the panel.

In this configuration, when the handle support member is fixed to the panel by using the bolt and the nut, a distance between the spacer and the head portion of the bolt in the vehicle width direction is maintained to be a constant distance, and the spacer and the panel are sandwiched between the head portion of the bolt and the nut. In other words, while both of the metal spacer and panel are sandwiched between both of the metal bolt and nut, the bolt and nut exert an axial force on the spacer and the panel. Therefore, since creep is unlikely to occur (plastic deformation is unlikely to occur) in the spacer although the handle device is increased in temperature or time elapses, the axial force from the bolt and the nut is unlikely to be decreased.

Hence, it is possible to firmly fix the handle support member to the panel over a long period of time.

In the vehicle handle device according to the aspect of this disclosure, a protrusion may be provided on a facing surface of the handle support member that faces the head portion so as to protrude from the facing surface to the head portion side and may be crushed against the head portion when the head portion comes into contact with the other surface of the handle support member and the nut comes into contact with the other surface of the panel.

In this configuration, the protrusion provided on the handle support member is crushed against the head portion of the bolt, and thereby the handle support member (protrusion) is sandwiched between the panel and the head portion of the bolt. Therefore, compared to a case where no protrusion is provided, it is easy to sandwich the spacer between the panel and the head portion of the bolt and to sandwich the handle support member between the panel and the head portion.

The vehicle handle device according to the aspect of this disclosure may further include a nut-position regulating member that regulates movement of the nut to the head portion side by being capable of being temporarily held at a relative position with respect to the spacer in the vehicle width direction and coming into contact with the nut.

In this configuration, the handle support member and (a part of) the nut are positioned on both sides of the panel by using a hole formed in the panel and it is easy to perform an operation of sandwiching the panel between the handle support member and (a part of) the nut.

In the vehicle handle device according to the aspect of this disclosure, the spacer may have a cylindrical body that has an axis coaxial to the bolt and is positioned on an outer circumferential side of the bolt.

In this configuration, the spacer has great stiffness against the compression in an axial direction.

The vehicle handle device according to the aspect of this disclosure may further include a nut-position regulating member as a cylindrical body that regulates movement of the nut to the head portion side by being capable of being temporarily held at a relative position with respect to the spacer in the vehicle width direction and coming into contact with the nut. A recessed portion may be formed on the one surface of the handle support member so as to be continuous to the through-hole. The spacer may have a flange that is positioned to be relatively rotatable in the recessed portion. The spacer, the nut-position regulating member, and the nut may have non-circular cross sections that are different in size. When the bolt is caused to further rotate in a fastening direction in which an amount of screwing with the nut is increased in a case where both of the end portions of the spacer come into contact with the head portion and the one surface of the panel, an inner circumferential surface of the nut-position regulating member and an outer circumferential surface of the nut may come into contact with each other, an inner circumferential surface of the spacer and an outer circumferential surface of the nut-position regulating member may come into contact with each other, and further the flange may come into contact with an inner surface of the recessed portion.

In this configuration, the spacer, the nut, and the nut-position regulating member have the non-circular cross sections and the non-circular shapes vary in size from each other. Moreover, the spacer, the nut-position regulating member, and the nut are easily attached and detached from each other.

In addition, when the bolt is caused to rotate in the fastening direction by using a driver or the like, there is no need to regulate rotation of the nut by hand or the like.

Further, when the bolt is caused to further rotate in the fastening direction in which the amount of screwing with the nut is increased in the case where both of the end portions of the spacer come into contact with the head portion of the bolt and the one surface of the panel, respectively, it is possible to position the spacer and the nut in the rotation direction at predetermined positions.

In the vehicle handle device according to the aspect of this disclosure, a protrusion may be provided on a facing surface of the handle support member that faces the head portion so as to protrude from the facing surface to the head portion side and may be crushed against the head portion when the head portion comes into contact with the other-side surface of the handle support member and the nut comes into contact with the other-side surface of the panel. A small-diameter end portion as the end of the spacer on the head portion side may have a diameter smaller than a main body of the spacer which is adjacent to the small-diameter end portion.

In this configuration, it is possible to cause the position of the protrusion to approach the small-diameter end portion when viewed in the axial direction of the bolt.

Therefore, compared to a case where the small-diameter end portion is not provided in the spacer, it is possible to decrease a size of the head portion that has a function of crushing the protrusion.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A vehicle handle device comprising:

a resin handle support member having one surface in a vehicle width direction which faces one surface of a metal panel of a vehicle door;

a handle that is rotatably supported by the handle support member and causes, through rotating thereof, a locking device provided in the vehicle door to perform a transition from a latched state to an unlatched state;

a metal bolt that penetrates through a through-hole penetrating through the handle support member in the vehicle width direction, that penetrates through a bolt inserting hole formed in the panel so as to be relatively movable in the vehicle width direction, and that has a head portion facing another surface of the handle support member in the vehicle width direction;

a metal nut that faces another surface of the panel and is screwed with the bolt; and a metal spacer which is positioned between the head portion of the bolt and the other surface of the panel, and wherein end portions of the spacer in the vehicle width direction come into contact with the head portion of the bolt and the one surface of the panel, respectively, when the head portion of the bolt comes into contact with the other surface of the handle support member and the nut comes into contact with the other surface of the panel.

2. The vehicle handle device according to claim 1, wherein at least one protrusion is provided on the other surface of the handle support member that faces the head portion of the bolt so as to protrude from the other surface of the handle support member toward the head portion of the bolt and is crushed against the head portion when the head portion comes into contact with the other surface of the handle support member and the nut comes into contact with the other surface of the panel.

3. The vehicle handle device according to claim 1, further comprising:

a nut-position regulating member that regulates movement of the nut toward the head portion of the bolt by being capable of being temporarily held at a relative position with respect to the spacer in the vehicle width direction and coming into contact with the nut.

4. The vehicle handle device according to claim 1, wherein the spacer is a cylindrical body that has an axis coaxial to the bolt and is positioned on an outer circumference of the bolt.

5. The vehicle handle device according to claim 4, further comprising:

a nut-position regulating member as a cylindrical body that regulates movement of the nut toward the head portion of the bolt by being capable of being temporarily held at a relative position with respect to the spacer in the vehicle width direction and coming into contact with the nut, wherein at least one recessed portion is formed on the one surface of the handle support member so as to be continuous to the through-hole, wherein the spacer has at least one flange that is positioned to be relatively rotatable in the at least one recessed portion, wherein the spacer, the nut-position regulating member, and the nut have non-circular cross sections that are different in size, and wherein, when the bolt is caused to further rotate in a fastening direction in which an amount of screwing with the nut is increased in a case where both of the end portions of the spacer come into contact with the head portion and the one surface of the panel, an inner circumferential surface of the nut-position regulating member and an outer circumferential surface of the nut come into contact with each other, an inner circumferential surface of the spacer and an outer circumferential surface of the nut-position regulating member come into contact with each other, and further the at least one flange comes into contact with an inner surface of the at least one recessed portion.

6. The vehicle handle device according to claim 4, wherein at least one protrusion is provided on the other surface of the handle support member that faces the head portion of the bolt so as to protrude from the other surface of the handle support member toward the head portion of the bolt and is crushed against the head portion when the head portion comes into contact with the other surface of the handle support member and the nut comes into contact with the other surface of the panel, and wherein the spacer includes a small-diameter end portion forming one of the end portions of the spacer on a side close to the head portion of the bolt having a diameter smaller than a main body of the spacer which is adjacent to the small-diameter end portion.

* * * * *